US005620404A

United States Patent [19]

Eyman

[11] Patent Number: 5,620,404

[45] Date of Patent: Apr. 15, 1997

[54] MUSCLE STRETCHING TRAINER SYSTEM

[75] Inventor: Waldorf C. Eyman, Whitney, Tex.

[73] Assignee: Gym-Trix, Inc., Durham, N.H.

[21] Appl. No.: 515,961

[22] Filed: Aug. 16, 1995

[51] Int. Cl.[6] ..... A63B 23/04

[52] U.S. Cl. ..... 482/142; 482/25; 482/52; 482/907

[58] Field of Search ..... 297/423.44, 423.41; 108/56.3, 64, 91; 482/25, 35, 907, 52; 446/108, 112, 115

[56] References Cited

U.S. PATENT DOCUMENTS

| | | | |
|---|---|---|---|
| 3,006,643 | 10/1961 | Ryan | 482/142 |
| 4,203,525 | 5/1980 | Okubo | 482/25 |
| 4,429,868 | 2/1984 | Leblanc et al. | 482/907 |
| 4,531,730 | 7/1985 | Chenera | 482/907 |
| 5,269,735 | 12/1993 | Pfitzenmeier | 482/52 |
| 5,382,209 | 1/1995 | Pasier et al. | 482/52 |

FOREIGN PATENT DOCUMENTS

| | | | |
|---|---|---|---|
| 538563 | 8/1941 | United Kingdom | 482/25 |

*Primary Examiner*—Jerome Donnelly
*Attorney, Agent, or Firm*—Davis and Bujold

[57] ABSTRACT

The invention provides a system for aiding a person in stretching his or her muscles, such as a gymnast. The system comprises a trapezoid shaped base having a pair of pivot grooves formed in a top surface thereof to accommodate adjacent ends of a pair of boards. The spacing of the primary base from the floor or other support surface may be varied by using one or more secondary bases. The various components of the system may be arranged or configured to meet the stretching needs of the user or may be arranged to function as a step for step aerobics. The purpose of the muscle stretching trainer system is to allow for the isolation of muscle groups in order to develop flexibility.

20 Claims, 5 Drawing Sheets

MUSCLE STRETCHING TRAINER SYSTEM

This invention relates to a system for aiding a person, such as a gymnast, in stretching his or her leg and hip muscles. The invention also relates to a kit of parts for assembling an apparatus for stretching desired muscles of a user. The various components comprising the invention may be arranged in a plurality of different configurations to meet the stretching needs of the user or, alternatively, may be arranged to function as a step for step aerobics.

BACKGROUND OF THE INVENTION

The isolation of muscle groups is one of the key factors in developing flexibility for athletes. A gymnast working on his or her split daily may never attain a flat square split. This suggests that he or she is not sufficiently working a problem area which usually is the hip flexor group. Because everyone avoids his or her weaker and less flexible side, even seemingly flexible athletes will benefit from isolating the muscle groups that are rarely used.

There are some key points to note with regard to the isolation of muscle groups:

1. Isolation of a muscle allows for the stretching of the complete muscle.

2. Because of compensation, often specific and very important muscles are stretched very little or not at all.

3. Tightness and overtraining make proper positioning during stretching even more difficult especially without the assistance of a coach to physically help with the stretching.

4. Isolation helps to focus the allotted stretching time on each individual's problem area or areas.

5. Lastly and most important, a subtle improvement in the flexibility of specific muscles can result in a dramatic change in the range of motion, performance and comfort of an athlete.

One example of the need for isolated stretching can be found in the oblique muscles which initiate twisting in the torso of the gymnast. The back of the oblique muscles becomes very tight on the side to which the gymnast twists. The front of the oblique remains flexible due to all of the inherent arching in gymnastics.

This imbalance of the oblique muscle can be very detrimental. If one side of the back is shorter than the other, a back injury can readily occur. This problem does not only occur with gymnastics where gymnasts always twist to the same side, but to any sport where there is one sidedness. When one arm is stronger than the other, that part of the back is also stronger which usually means that side is also tighter. In one sided sports, it is especially important to maintain balanced flexibility to avoid injury.

Most athletes who have back injuries also have tight hip flexors. Most gymnasts who have back problems have both tight hip flexors and tight shoulders. The hip flexors are used in tucking and running. Athletes who engage in these activities should stretch the hip flexors after as well as before working out. This would also apply to athletes who tend to overexert his or her back and should muscles.

Stretching the abductors is also important to prevent what many coaches and athletes refer to as a "groin pull." This muscle is typically weak (with the exception to dancers) and rather tight, making it very vulnerable to injury.

Prior art devices and systems have been made to attempt isolation of various muscle groups, however, suffer from providing a trainer system that is easy and safe to operate.

One such known device of the inventors provides a hinge for connecting two boards end to end. The hinge tends to pinch the user's legs and/or hands thereby causing injury. In addition, the assembly is placed over foam support bases to allow the boards to pivot about the hinge. These foam support bases inherently create an unstable structure which may result in an additional unsafe condition.

SUMMARY OF THE INVENTION

Wherefore, it is an object of the present invention to overcome the aforementioned problems.

It is a further object of the present invention to provide a trainer system adaptable to a variety of configurations for stretching desired muscles of a user.

Another objective of the invention is to provide hingeless boards with pivot feet which are engageable with pivot grooves in a support base thereby to create a stable trainer system in which to perform stretching exercises.

Another objective of the invention is to provide a step aerobic exerciser whereby the trainer system having a board and two support bases may be arranged in a step aerobic exerciser configuration.

The present invention relates to a kit of parts for stretching muscles of a user, said kit of parts comprising a primary base having a second surface and a pair of adjacent elongate pivot grooves provided in a first opposed surface thereof; and a pair of elongate boards each having a foot formed in a surface thereof adjacent at least one end of each of the elongate boards, the foot being sized to intimately engage with one of the pivot grooves provided in the primary base and facilitate pivoting movement between the board and the primary base.

The present invention further relates to an apparatus for stretching muscles of a user, said apparatus comprising: a primary base having a second surface and a pair of adjacent elongate pivot grooves provided in a first opposed surface thereof; a pair of elongate boards each having a foot formed in a surface thereof adjacent both ends of each of the elongate boards, each foot being sized to intimately engage with one of the pivot grooves provided in the primary base and facilitate pivoting movement between the board and the primary base; a plurality of secondary bases which are interconnectable with said primary base to space said primary base a desired distance from a support surface, each of said plurality of secondary bases having a recess formed in a second surface thereof which is sized to intimately engage with a first surface of another secondary base to provide a stable stacked interconnection between two adjacent secondary bases, and each of said plurality of secondary bases having a reinforcing internal wall to prevent each said secondary base from collapsing when subjected to a load.

The present invention also relates to a method for stretching muscles comprising the steps of providing a primary base with a second support surface and a pair of adjacent elongate pivot grooves being provided in a first opposed surface thereof; forming a foot in a pair of elongate boards in a surface adjacent both ends thereof, sizing each foot to intimately engage with one of the pivot grooves provided in the primary base and facilitate pivoting movement between the board and the primary base; interconnecting at least one secondary base with said primary base to space said primary base a desired distance from a support surface, and providing a reinforcing internal wall in said at least one secondary base to prevent said at least one secondary base from collapsing when subjected to a load.

BRIEF INTRODUCTION TO THE DRAWING

The invention will now be described, by way of example, with reference to the accompanying drawings, in which.

DETAILED DESCRIPTION OF THE INVENTION

Figure 1:
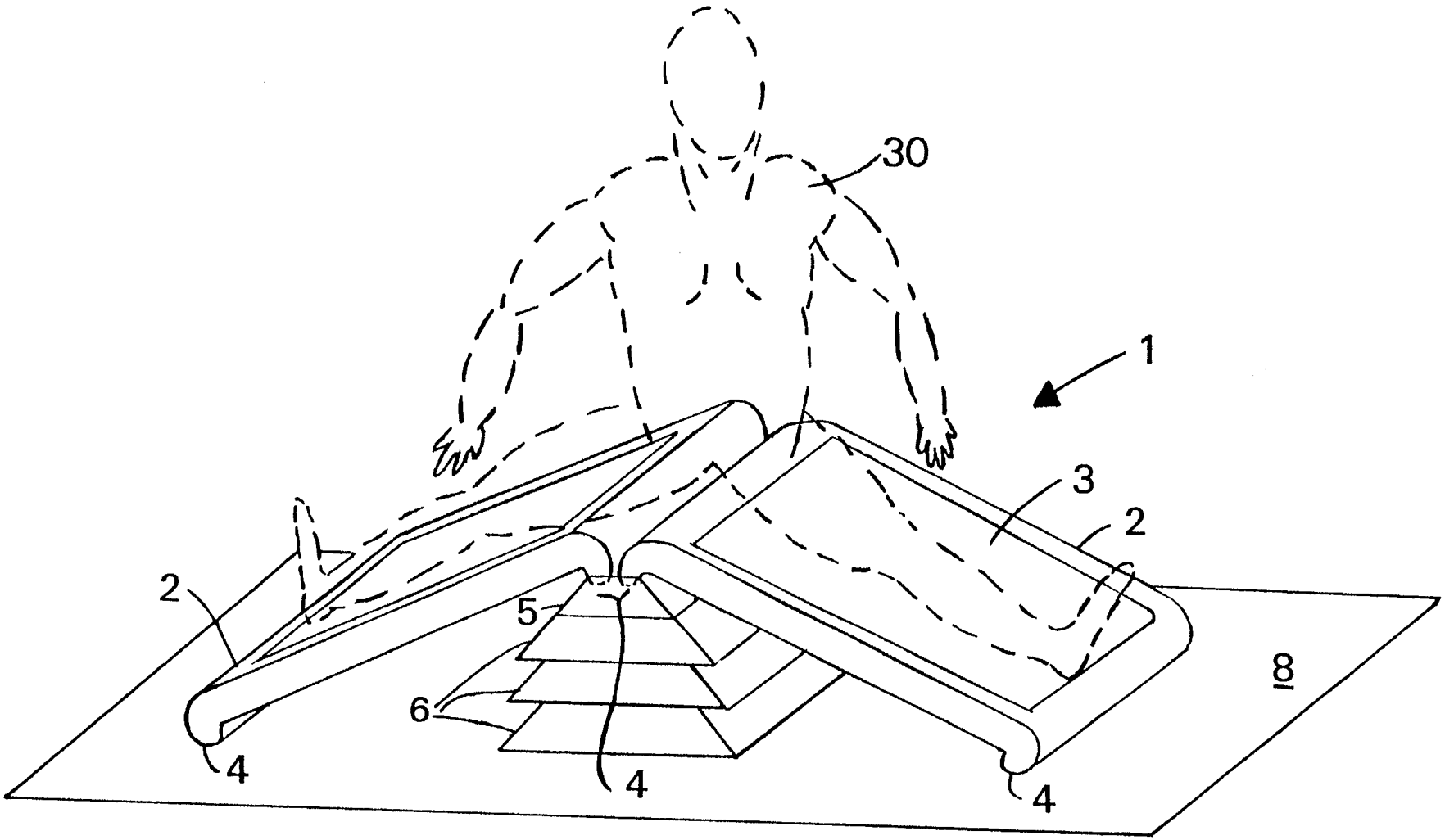
FIG. 1 is a diagrammatic perspective view of the various components of the present invention showing a typical configuration in which to stretch desired muscles of a user.
Figure 12:
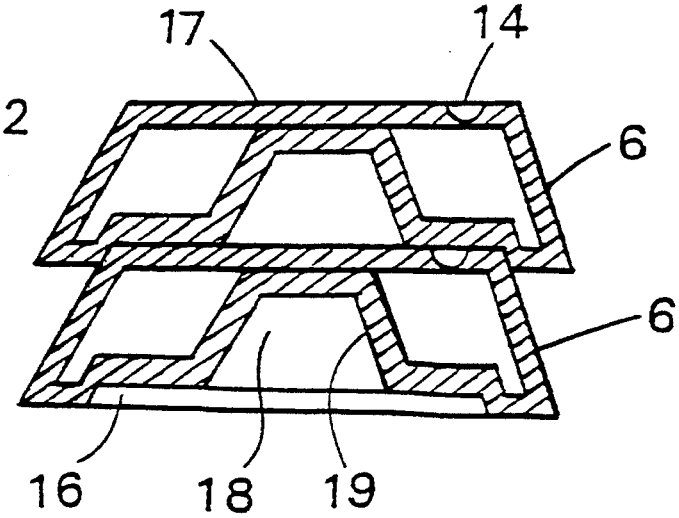
FIG. 12 is a diagrammatic cross sectional view showing stacking of two secondary bases.

Turning first to FIG. 1, a muscle stretching trainer system 1 according to the present invention is shown. A user 30 is shown in phantom isolating and stretching his or her legs and hips muscles. The system 1 comprises a pair of separate, identical spaced apart elongate boards 2, each having a first top padded surface 3 and a pair of opposed pivot feet 4 located adjacent opposed ends of a second bottom surface of each board 2. The boards are typically arranged end to end (FIG. 1) and have a length of about 36 inches (91 mm), but the length of the boards may vary depending upon the application. The pivot feet 4 are positioned at the ends of the boards and located to engage with one of the two adjacent pivot grooves 10 (see FIG. 2) provided in a top first surface of a stackable primary base 5, a further description concerning engagement between these components will follow hereinafter. The pivot feet 4 of the board 2 are preferable rounded at the end so as to facilitate a pivoting engagement with the pivot groove 10. The primary base 5 may be directly supported by the floor or may be supported by one or more secondary bases 6, e.g. between one and four secondary bases (FIGS. 1, 6 and 7), which are interconnected with one another and the primary base 5. FIG. 12 shows two secondary bases 6 interconnected with one another. A detailed description with respect to such connection will be provided below.

Figure 2:
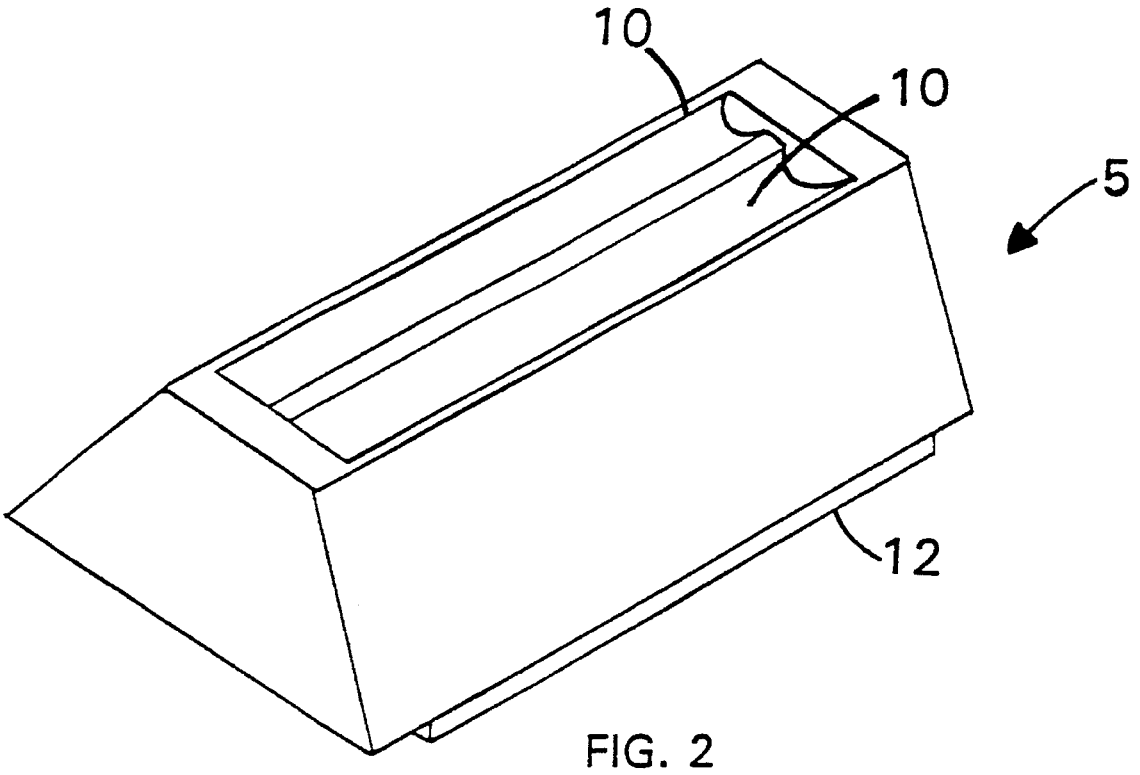
FIG. 2 is a diagrammatic perspective view of the trapezoid pivot base of the present invention.
Figure 3:
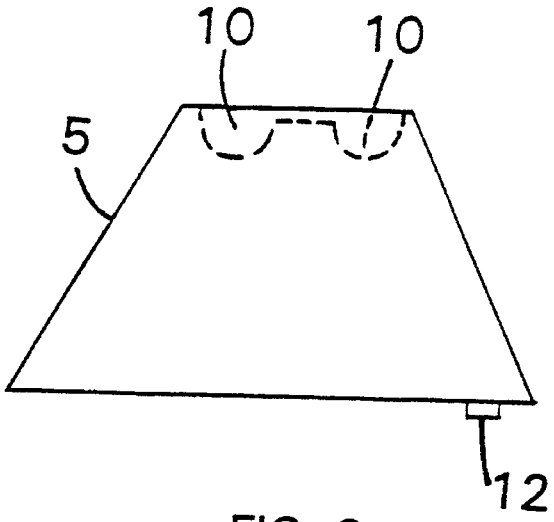
FIG. 3 is a diagrammatic side view of the trapezoid base.

Turning to now to FIGS. 2 and 3, a detail description of the primary base 5 will now be provided. The primary base is preferably trapezoid in transverse cross sectional shape so as to allow the boards 2 to be positioned at various stretching angles 20 with respect to one another as will become apparent hereinafter, e.g. to form a stretching angle of between about 100 to about 200 degrees (see FIGS. 1 and 6–9) The pair of adjacent pivot grooves 10 are provided in the first top surface of the primary base 5 while an elongate locking tab 12, e.g. either rectangular or semi-circular in transverse cross section, is provided in the second bottom surface of the primary base 5. Each of the pivot grooves 10 is rounded, i.e. substantially semicircular in shape, to facilitate acceptance of the mating rounded foot 4 of the board 2. The engagement between the foot 4 and the pivot groove 10 allows the boards 2 to pivot relative to the primary base 5 to the desired stretch angle 20 without the need of any hinge between these components. The elongate locking tab 12 of the primary base 5 engages with a tab groove 14 provided in the first top surface of the secondary base 6 (see FIG. 4) to facilitate an interlocked stacking of the primary base 5 with one of the secondary bases 6.

Figure 4:
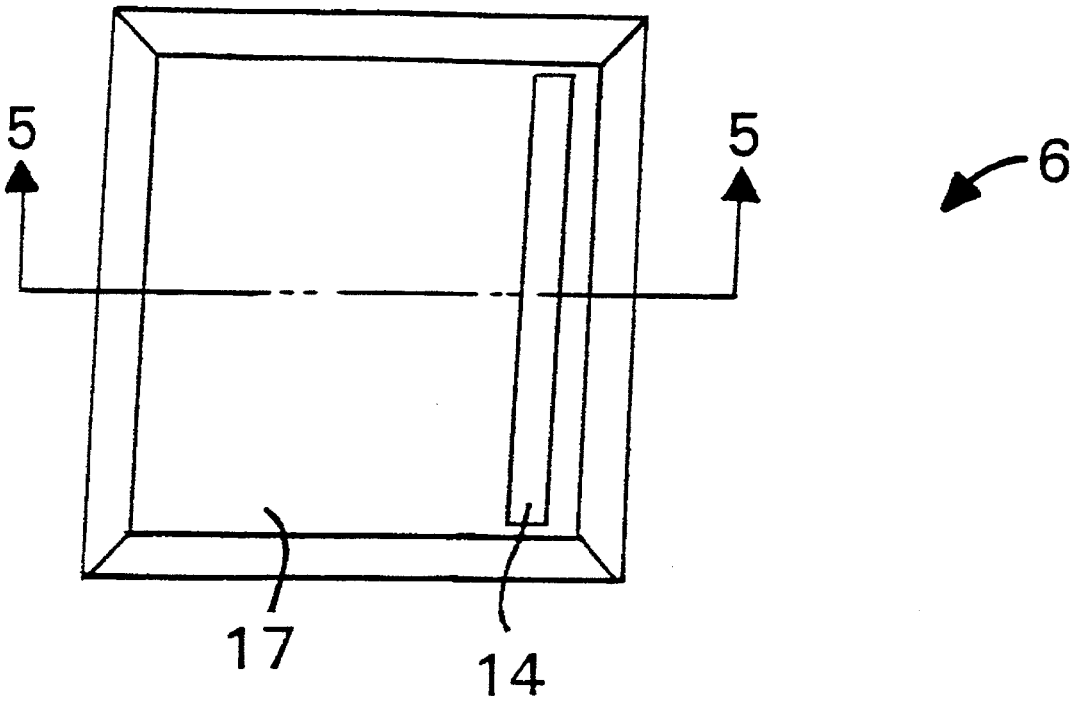
FIG. 4 is a diagrammatic top plan view of a secondary base of the present invention.
Figure 5:
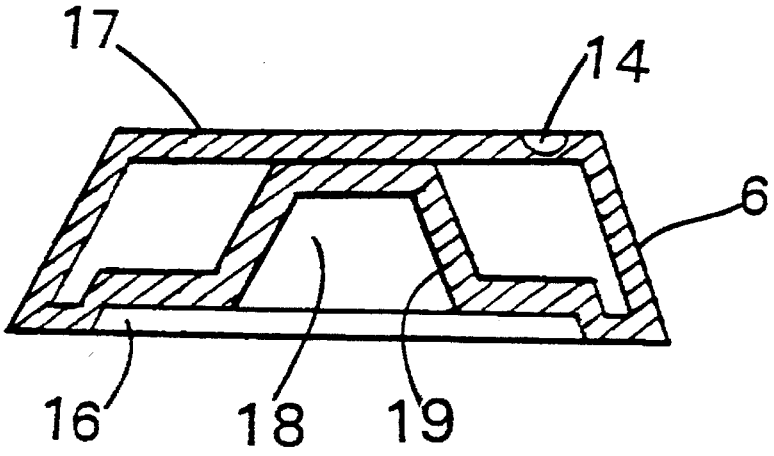
FIG. 5 is a diagrammatic sectional view of the secondary base taken along sectional line 5—5 of FIG. 4.

With reference now to FIGS. 4 and 5, a detail description of the secondary base 6 will now be provided. The tab groove 14 is provided in the top first surface 17 of at least one and preferably each secondary base 6 adjacent one edge thereof for intimately receiving the locking tab 12. Preferably, the tab groove 14 is sized to also accept a pivot foot 4 of the board 2, as can be seen with reference to FIGS. 9–11. As such, the tab groove 14 may be rounded, i.e. substantially semicircular in shape, to facilitate acceptance of the mating rounded foot 4 of the board 2. In addition, secondary base 6 is provided with a recess 16 sized to accommodate intimately the first top surface 17 of one of the secondary bases 6. The intimate engagement between the recess 16 provided in one secondary base 6 with the first top surface 17 of another secondary base 6 is such that relative horizontal movement in any direction between the two stacked secondary bases 6 is substantially prevented. The engagement between the recess 16 and the first surface of one of the secondary bases 6 is essentially interlocked. Each secondary base 6 is also provided with a reinforcing structure 18 having at least one column or wall 19, preferably four walls, which acts to transfer load from the first surface to its second surface or the floor.

Figure 6:
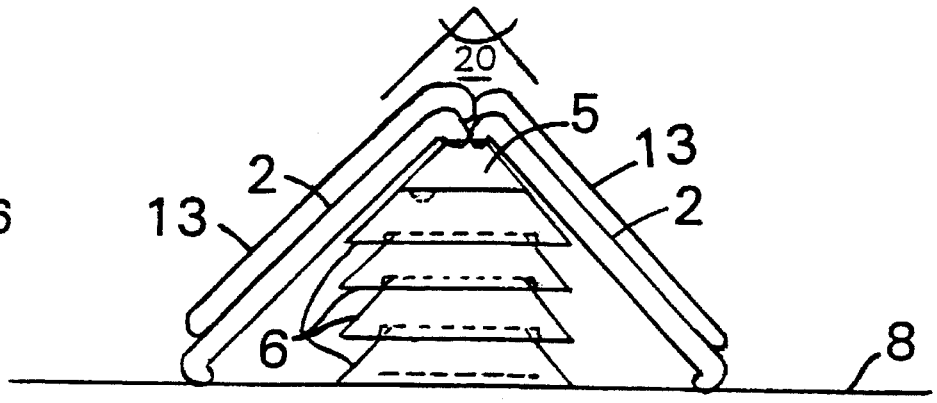
FIGS. 6–11 show various exemplary arrangements of the components of the present invention.
Figure 7:
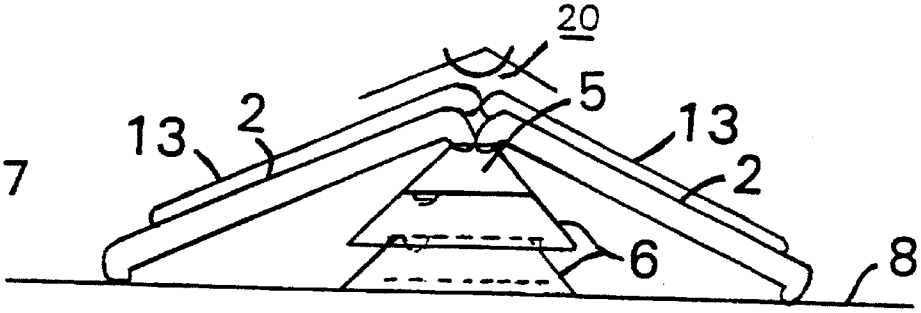
Figure 8:
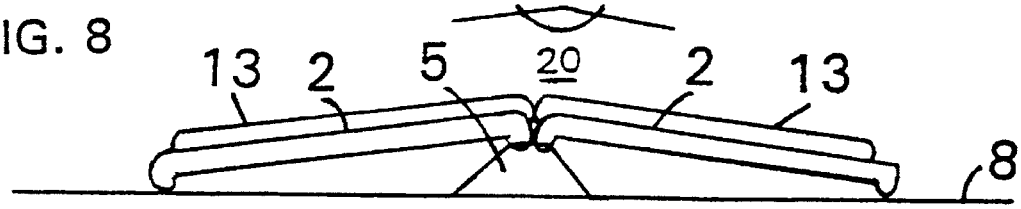

Turning now to FIGS. 6–11, various readily achievable configurations of the system 1 according to the present invention are shown. As can be seen in FIG. 6, four secondary bases 6 are stacked in an interlocked arrangement to support the primary base 5 which, in turn, supports one end of the pair of boards 2 to provide a minimum stretching angle 20 for a user 30 of about 116 degrees. By removing one or more secondary bases 6 from the configuration shown in FIG. 6 (see FIGS. 1, 7 and 8), the user can gradually increase the stretching angle 20. For example, by removing one secondary base 6 (see FIG. 1), the stretching angle 20 is increased to about 129 degrees; or by removing two secondary bases 6 (see FIG. 7), the stretching angle 20 is increased to about 141 degrees. Similarly, by removing all of the secondary bases 6 so that the second surface of the primary base 5 is directly supported on the floor 8 and placing a foot 4 of a first end of each board 2 in a pivot groove 10 of the primary base 5 while the second opposed ends of the boards 2 rest on the floor or some other supporting surface 8 (see FIG. 8), a stretching angle 20 of about 165 degrees can be achieved. If a stretch angle 20 of about 180 degrees is desired, this can be accomplished by placing the pair of boards 2 directly on the floor 8 in an end to end relationship.

Figure 9:
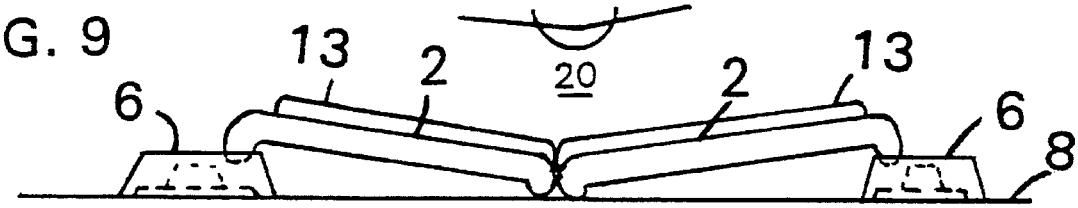

If an over split is desired, i.e. a stretching angle 20 of about 193 degrees, this can be accomplished by completely removing the primary base 5, placing the two adjacent ends of the boards 2 in an abutting position on the floor 8, and supporting the two opposite ends of the boards 2 with a secondary base 6 (FIG. 9). The over split stretching angle 20 can be further increased by utilizing two or more stacked secondary bases 6 to support the two opposite ends of the boards 2.

Figure 10:
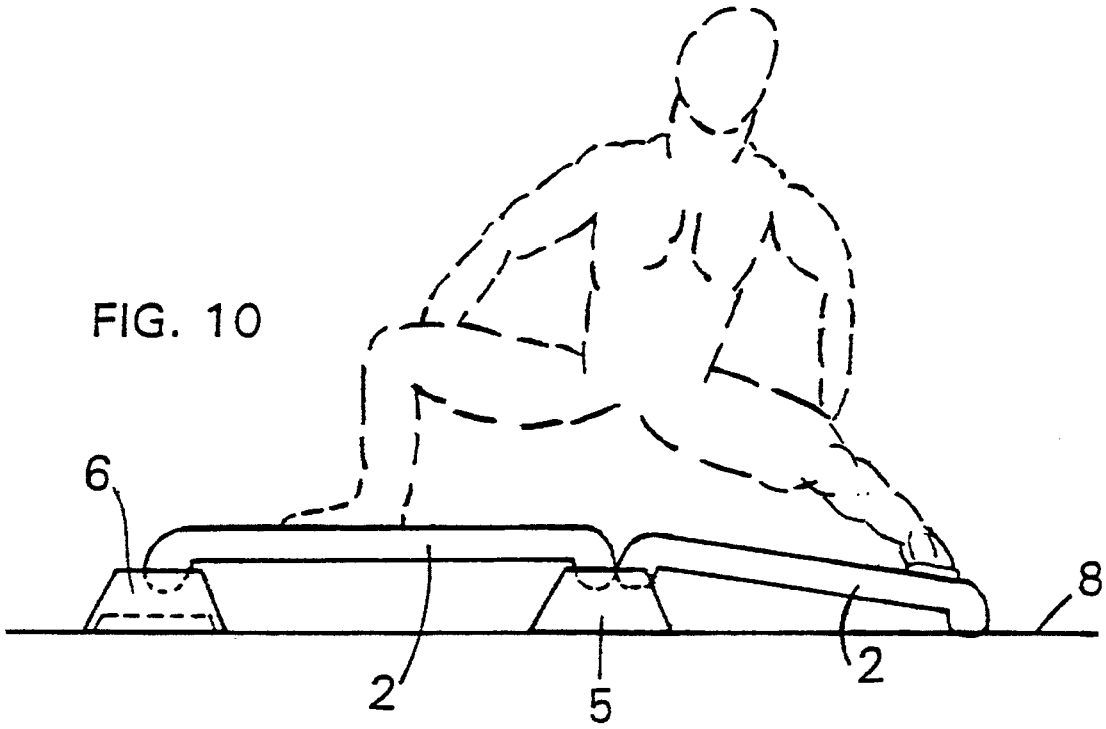

FIG. 10 shows the system 1 according to the present invention configured to allow the user 30 to step into a lunge position with a front leg turned out and a back leg extending parallel to the board 2 which is slightly inclined relative to the floor 8, i.e. angled. The hips of the user 30 are square and both heals are touching the boards 2.

Figure 11:
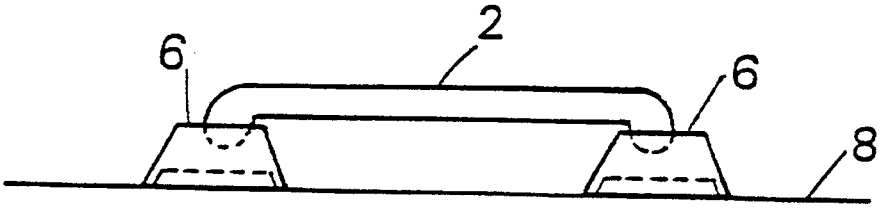

Turning to FIG. 11, another possible arrangement of the system 1 is shown, e.g. the system 1 is arranged as a step for step aerobics. In this embodiment, a pair of spaced apart secondary bases 6 are utilized and the foot 4 of each end of the board 2 is supported by the tab groove 14 provided in a secondary base 6. If desired, each end of the second board 2 may be supported by a pair of interlocked secondary bases 6 to form a second aerobic step which has a height that is approximately twice that of the step shown in FIG. 11. It can be seen the system according to the present invention is truly versatile and can readily be configured to a variety of other configurations.

The system 1 may also be fitted with an optional flex-fill comforter 13 in place of or in addition to the pad 3 shown in FIG. 1. The comforter 13 provides a comfortable fit for each individual user's 30 leg/hip musculative and frame. As shown in FIGS. 6–9, for example, the comforter is placed on the top surface of the boards 2. The comforter may contain polystyrene beads, for example. In order to prevent these beads from migrating down the incline of the boards 2, the comforter preferably contains a plurality of closed cells or pockets, for containing the beads. Accordingly, any migration of the beads will be limited to the size of the cell or pocket. The comforter 13 is preferably releasably secured to the top surface of the boards 2 via a first touch fastener secured to a bottom surface of the comforter and a second mating touch fastener secured to a top surface of the board. Other known releasable fastening means could also be employed for connecting the comforter to the board.

The primary base 5, the boards 2, and the secondary bases 6 may be made from molded plastic material such as polyethylene. However, as will be apparent to one of ordinary skill in the art, any other known lightweight and durable material may be employed. The primary base 5 and the secondary bases are designed to be stable members, i.e. they are designed with a low center of gravity and are thus not prone to tip or be readily knocked over while supporting the anticipated loads.

As noted above, the tab groove 14 of the secondary base 6 can also intimately accommodate the pivot foot 4 of the board 2.

The height of the primary base 5 and the secondary bases 6 are all about the same height, e.g. about 4¼ inches inches (11 mm). The secondary bases 6 have a second surface dimension of approximately 18 by 15 inches (46×38 mm). The primary base 5 has a second surface dimension of approximately 21 by 12 inches (53×30 mm).

It is to be appreciated that the overall shape, height, width, length, and cross sectional configuration of the primary base and the secondary bases can be varied as necessary or desired depending upon the application. The critical feature for these components is that they do not hinder the range of pivoting movement necessary for the boards to facilitate proper location for stretching of the user's muscles.

All of the components comprising the system according to the present invention have rounded edges to minimize cutting or injury to a user of the system.

Since certain changes may be made in the above described stretching system without departing from the spirit and scope of the invention herein involved, it is intended that all matter contained in the above description or shown in the accompanying drawings shall be interpreted merely as examples illustrating the inventive concept herein and shall not be construed as limiting the invention.

What is claimed is:

1. A Kit of parts for stretching muscles of a user, said kit of parts comprising:

a primary base having an upper first surface supporting one of a pair of adjacent elongate pivot grooves or a pair of adjacent feet, a lower opposed second surface being connected to said first surface by a sidewall, and said primary base having a width; and a pair of elongate boards each including the other of said elongate pivot groove or a foot, formed in a surface thereof adjacent at least one end of each of said elongate boards, for mating with one of said pair of adjacent elongate pivot grooves or said pair of adjacent feet su,ported by said first surface, each of said elongate boards having e width substantially equal to the width of said primary base, and each said foot being sized to intimately engage with one of said pair of adjacent elongate pivot grooves to facilitate pivoting movement between said board and said primary base.

2. The kit of parts according to claim 1, wherein each of said elongate boards has a foot formed adjacent both opposed ends thereof, and both feet are sized to intimately engage with one of the pivot grooves provided in the primary base and facilitate pivoting movement between the board and the primary base.

3. The kit of parts according to claim 2, wherein said kit further comprises a secondary base which is interconnectable with said primary base to space said primary base a desired distance from a support surface.

4. The kit of parts according to claim 3, wherein said kit further comprises a plurality of secondary bases which are interconnectable with said primary base to space said primary base a desired distance from a support surface.

5. The kit of Darts according to claim 4, wherein said kit comprises four secondary bases which are interconnectable with said primary base to space said primary base a desired distance from a support surface.

6. The kit of parts according to claim 4, wherein each of said plurality of secondary bases has a recess formed in a second surface thereof which is sized to intimately engage with a first surface of another secondary base to provide a stable stacked interconnection between two adjacent secondary bases.

7. The kit of parts according to claim 6, wherein each of said plurality of secondary bases has a reinforcing internal wall to prevent each said secondary base from collapsing when subjected to a load.

8. The kit of parts according to claim 6, wherein said second surface of said primary base is provided with a locking tab and at least one of said plurality of secondary bases is provided with a tab groove in said first surface thereof, and said locking tab is located to engage with said tab groove of said at least one of said plurality of secondary bases to interconnect said primary base with said at least one secondary base.

9. The kit of parts according to claim 2, wherein a pad secured to each of said pair of elongate boards opposite on the surface of said board supporting said pivot feet.

10. The kit of parts according to claim 3, wherein said primary base is trapezoidal in transverse cross sectional shape and has a width which is smaller than a width of said at least one secondary base.

11. The kit of parts according to claim 4, wherein said pivot feet and said pair of adjacent pivot grooves are rounded to facilitate pivoting movement therebetween.

12. The kit of parts according to claim 4, wherein said pivot feet, said tab groove provided in a top surface of at least one of said secondary bases and said pair of adjacent pivot grooves have a semi-circular cross section.

13. The kit of parts according to claim 2, wherein a comforter is placed on at least one elongate board opposite on the surface of said board supporting said pivot feet.

14. An apparatus for stretching muscles of a user, said apparatus comprising:

a primary base having an upper first surface supporting one of a pair of adjacent elongate pivot grooves or a pair of adjacent feet, a lower opposed second surface being connected to said first surface by a sidewall, and said primary base having a width;

a pair of elongate boards each including the other of said elongate pivot groove or a foot, formed in a surface thereof adjacent at least one end of each of said elongate boards, for mating with one of said pair of adjacent elongate pivot grooves or said pair of adjacent feet supported by said first surface, each of said elongate boards having a width substantially equal to the width of said primary base, and each said foot being sized to intimately engage with one of said pair of adjacent elongate pivot grooves to facilitate pivoting movement between said board and said primary base; and a plurality of secondary bases which are interconnectable with said primary base to space said primary base a desired distance from a support surface, each of said plurality of secondary bases having a recess formed in a second surface thereof which is sized to intimately engage with a first surface of another secondary base to provide a stable stacked interconnection between two adjacent secondary bases, and each of said plurality of secondary bases having a reinforcing internal wall to prevent each said secondary base from collapsing when subjected to a load.

15. The apparatus according to claim 14, wherein said second surface of said primary base is provided with a locking tab and at least one of said plurality of secondary bases is provided with a tab groove in said first surface thereof, and said locking tab is located to engage with said tab groove of said at least one of said plurality of secondary bases to interconnect said primary base with said at least one secondary base.

16. The apparatus according to claim 15, wherein a pad secured to each of said pair of elongate boards opposite on the surface of said board supporting said pivot feet.

17. The apparatus according to claim 16, wherein said primary base is trapezoidal in transverse cross sectional shape and has a width which is smaller than a width of said at least one secondary base.

18. The apparatus according to claim 17, wherein said pivot feet, said tab groove provided in a top surface of at least one of said secondary bases and said pair of adjacent pivot grooves have a semi-circular cross section.

19. The apparatus according to claim 15, wherein a comforter is supported on at least one elongate board opposite on the surface of said board supporting said pivot feet.

20. A method for stretching muscles comprising the steps of:

providing a primary base with an upper first surface including one of a pair of adjacent elongate pivot grooves or a pair of adjacent feet, a lower opposed second surface being connected to said first surface by a sidewall, and said primary base having a width; and forming, adjacent at least one end of a pair of elongate boards, the other of said elongate pivot groove or a foot, for mating with the other of said pair of adjacent elongate pivot grooves or said pair of adjacent feet supported by said first surface, each of said elongate boards having a width substantially equal to the width of said primary base, and each said foot being sized to intimately engage with one of said pair of adjacent elongate pivot grooves to facilitate pivoting movement between the board and the primary base;

interconnecting at least one secondary base with said primary base to space said primary base a desired distance from a support surface; and providing a reinforcing internal wall in said at least one secondary base to prevent said at least one secondary base from collapsing when subjected to a load.

* * * * *